US011713202B2

(12) United States Patent
Lin et al.

(10) Patent No.: US 11,713,202 B2
(45) Date of Patent: Aug. 1, 2023

(54) FOLDABLE BAFFLE STRUCTURE

(71) Applicant: Foxlink Image Technology Co., Ltd., New Taipei (TW)

(72) Inventors: Yuan Yi Lin, New Taipei (TW); Chih Yuan Yang, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 250 days.

(21) Appl. No.: 17/378,522

(22) Filed: Jul. 16, 2021

(65) Prior Publication Data

US 2022/0281246 A1 Sep. 8, 2022

(30) Foreign Application Priority Data

Mar. 2, 2021 (TW) ..... 110202210

(51) Int. Cl.
*B65H 1/04* (2006.01)
*B41J 13/10* (2006.01)

(52) U.S. Cl.
CPC ..... *B65H 1/04* (2013.01); *B41J 13/103* (2013.01); *B65H 2405/11425* (2013.01); *B65H 2511/12* (2013.01)

(58) Field of Classification Search
CPC ..... B65H 1/04; B65H 2405/114; B65H 2405/1142; B65H 2405/11425; B65H 2405/1144; B65H 2405/115; B65H 2511/12
See application file for complete search history.

(56) References Cited

U.S. PATENT DOCUMENTS 6,053,491 A * 4/2000 Cheong ..... B65H 3/0661 271/171
8,141,868 B1 * 3/2012 Wang ..... B65H 1/04 271/248
2015/0097329 A1 * 4/2015 Ukai ..... B65H 1/04 271/9.12
2016/0332828 A1 * 11/2016 Wakakusa ..... B65H 5/26

* cited by examiner

*Primary Examiner* — Prasad V Gokhale
(74) *Attorney, Agent, or Firm* — Lin & Associates Intellectual Property, Inc.

(57) ABSTRACT

A foldable baffle structure is mounted to a tray of a scanner or a printer. The foldable baffle structure includes two limiting components mounted to the tray. Each limiting component includes a sliding element, a stopping element, a guiding element and a pivoting element. Middles of the two sliding elements of the two limiting components have two accommodating spaces penetrating through top surfaces and bottom surfaces of the two sliding elements. The two stopping elements of the two limiting components are mounted in the accommodating spaces of the two limiting components. A middle of one end surface of the stopping element protrudes outward to form a pivoting portion. The guiding element is mounted around an outside of the pivoting portion. The pivoting element is pivotally disposed in the stopping element.

14 Claims, 12 Drawing Sheets

FOLDABLE BAFFLE STRUCTURE

CROSS-REFERENCE TO RELATED APPLICATION

The present application is based on, and claims priority from, Taiwan Patent Application No. 110202210, filed Mar. 2, 2021, the disclosure of which is hereby incorporated by reference herein in its entirety.

BACKGROUND OF THE INVENTION

1. Field of the Invention

The present invention generally relates to a baffle structure, and more particularly to a foldable baffle structure.

2. The Related Art

Traditionally, a paper feeding mechanism in a conventional scanner needs to guide paper or cards, a guiding structure of the conventional scanner is mounted to a tail end of a baffle of the conventional scanner. In this way, even though the paper is warped or is stacked in disorder, the paper or the card can smoothly and successfully enter into the conventional scanner under an action of the guiding structure.

However, the baffle and the guide structure of the conventional scanner are fixed structures, so when a tray of the conventional scanner is retracted, the baffle and guiding structure will take up a larger space, and the conventional scanner as a product is caused to need a larger appearance size.

Therefore, it is necessary to provide a foldable baffle structure to reduce an appearance size of a product and to further reduce a material cost.

SUMMARY OF THE INVENTION

An object of the present invention is to provide a foldable baffle structure mounted to a tray of a scanner or a printer. The foldable baffle structure includes two limiting components mounted to the tray. The two limiting components are corresponding to each other and are parallel to each other. Each limiting component includes a sliding element, a stopping element, a guiding element and a pivoting element. Middles of the two sliding elements of the two limiting components have two accommodating spaces penetrating through top surfaces and bottom surfaces of the two sliding elements. Two inner surfaces of two end walls of the accommodating space of each limiting component are recessed oppositely to form two opposite pivoting slots. The accommodating space of each limiting component has an extension portion arranged between and connected between two inner portions of two opposite side walls of the accommodating space of each limiting component. One side of an upper portion of the extension portion of each limiting component protrudes upward and then extends towards one end wall of the accommodating space to form a first pivoting block. The extension portion of each limiting component has a through-hole located below the first pivoting block. The two stopping elements of the two limiting components are mounted in the accommodating spaces of the two limiting components. Two opposite end surfaces of the stopping element protrude oppositely to form two second pivoting blocks. The two second pivoting blocks are disposed corresponding to the two pivoting slots, respectively. A middle of a bottom of the stopping element is recessed inward to form a receiving groove. A middle of a top wall of the receiving groove is further recessed inward to form a limiting groove. The two first pivoting blocks of the two sliding elements of the two limiting components are equipped with two elastic elements. Side walls of the two receiving grooves of the two stopping elements cover the two first pivoting blocks and the two elastic elements. One end of each elastic element passes through the through-hole of one sliding element and abuts against a bottom of the extension portion of the one sliding element, and the other end of each elastic element is inserted into the limiting groove of one stopping element. A middle of one end surface of the stopping element protrudes outward to form a pivoting portion. The pivoting portion has a pivoting opening slantwise extending from up to down and penetrating through two opposite end surfaces of the pivoting portion. The guiding element is mounted around an outside of the pivoting portion. Two ends of the guiding element slantwise protrude forward and sideward to form two bumps towards the pivoting portion. Two facing inner end surfaces of the two bumps of the guiding element define two fixing holes penetrating through two outer end surfaces of the two bumps. The guiding element is mounted to the pivoting portion, and the two fixing holes are corresponding to two opposite ends of the pivoting opening of the pivoting portion. The pivoting element is pivotally disposed in the pivoting opening of the stopping element. Two ends of the pivoting element are pivotally mounted in the two fixing holes of the guiding element, respectively.

Another object of the present invention is to provide a foldable baffle structure mounted to a tray of a scanner or a printer. The foldable baffle structure includes a limiting component mounted to the tray. The limiting component includes a sliding element, a stopping element, an elastic element, a guiding element and a pivoting element. A middle of the sliding element of the limiting component has an accommodating space penetrating through a top surface and a bottom surface of the sliding element. Two inner surfaces of two end walls of the accommodating space of the limiting component are recessed oppositely to form two opposite pivoting slots. The accommodating space of the limiting component has an extension portion arranged between and connected between two inner portions of two opposite side walls of the accommodating space of the limiting component. One side of an upper portion of the extension portion of the limiting component protrudes upward and then extends towards one end wall of the accommodating space to form a first pivoting block. The extension portion of the limiting component has a through-hole located below the first pivoting block. The stopping element is mounted in the accommodating space of the limiting component. Two opposite end surfaces of the stopping element protrude oppositely to form two second pivoting blocks. The two second pivoting blocks are disposed corresponding to the two pivoting slots, respectively. A middle of a bottom of the stopping element is recessed inward to form a receiving groove. A middle of a top wall of the receiving groove is further recessed inward to form a limiting groove. The elastic element is mounted around a free end of the first pivoting block of the sliding element of the limiting component. The first pivoting block and the elastic element of the limiting component are received in the receiving groove of the stopping element of the limiting component. One end of the elastic element passes through the through-hole of the sliding element and abuts against a bottom of the extension portion of the sliding element, and the other end of the elastic element is inserted into the limiting groove of the stopping element. A middle of one end surface of the stopping element protrudes outward to form a pivoting portion. The pivoting portion has a pivoting opening slantwise extending from up to down and penetrating through two opposite end surfaces of the pivoting portion. The guiding element is mounted around an outside of the pivoting portion. Two ends of the guiding element slantwise protrude forward and sideward to form two bumps towards the pivoting portion. Two facing inner end surfaces of the two bumps of the guiding element define two fixing holes penetrating through two outer end surfaces of the two bumps. The guiding element is mounted to the pivoting portion, and the two fixing holes are corresponding to two opposite ends of the pivoting opening of the pivoting portion. The pivoting element is pivotally disposed in the pivoting opening of the stopping element. Two ends of the pivoting element are pivotally mounted in the two fixing holes of the guiding element, respectively. When the foldable baffle structure is in an initial state, the elastic element props up the stopping element outwardly, and the stopping element abuts against the top surface of the sliding element, so that the stopping element maintains an upwardly upright state, when the tray and the stopping element enter a folded state and an accommodated state, the tray covers an outer shell of the scanner or the printer, the stopping element and the guiding element of the limiting component move towards an upper surface of a blocking wall of the outer shell of the scanner or the printer, and the stopping element and the guiding element of the limiting component are pushed inward by the upper surface of the blocking wall of the scanner or the printer.

Another object of the present invention is to provide a foldable baffle structure mounted to a tray of a scanner or a printer. The foldable baffle structure includes a sliding element, a stopping element and a guiding element. The sliding element is mounted to the tray. A middle of the sliding element has an accommodating space penetrating through a top surface of the sliding element. The stopping element is pivotally mounted in the accommodating space of the sliding element. The guiding element is pivotally mounted to one end surface of the stopping element. When the foldable baffle structure is in an initial state, the stopping element is pivoted to the sliding element to maintain in an upwardly upright state, the guiding element is pivoted to the stopping element to maintain an angle between the guiding element and the stopping element. When the foldable baffle structure is in a folded state, the stopping element is pivoted to the sliding element to be received in the accommodating space, the guiding element is pivoted to the stopping element to be maintained in a same plane with the stopping element.

As described above, the foldable baffle structure has a folded performance and an accommodated characteristic, so that a required space of the tray is saved, the two stopping elements of the two limiting components are able to return back to the initial states of the two stopping elements automatically by virtue of resilience characteristics of the two elastic elements, and correspondingly, the foldable baffle structure reduces an appearance size of a product which is the scanner or the printer and further reduces a material cost. As a result, it is convenient for the user to use the foldable baffle structure applied in the scanner or the printer.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
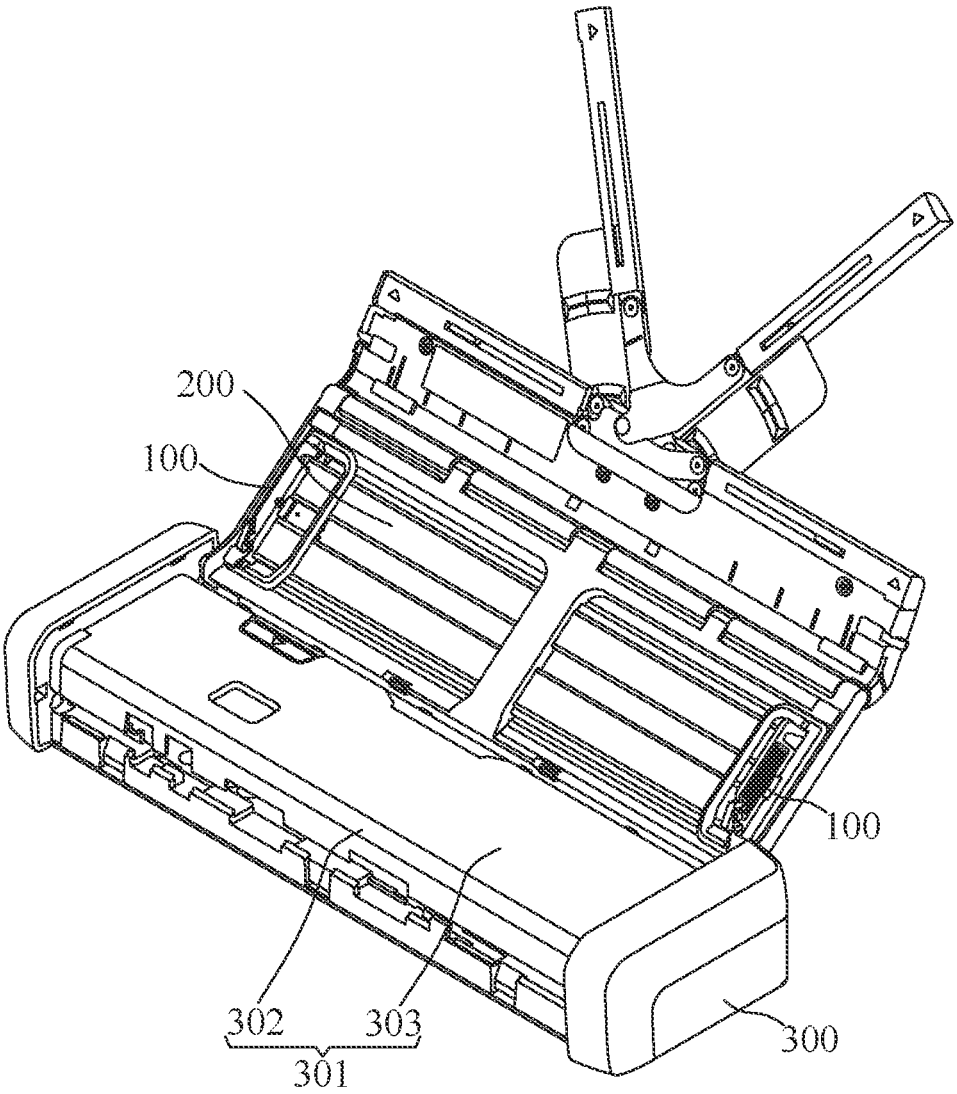
FIG. 1 is a perspective view of a scanner in accordance with a preferred embodiment of the present invention, wherein a foldable baffle structure and a tray are mounted to the scanner in accordance with the present invention.
Figure 2:
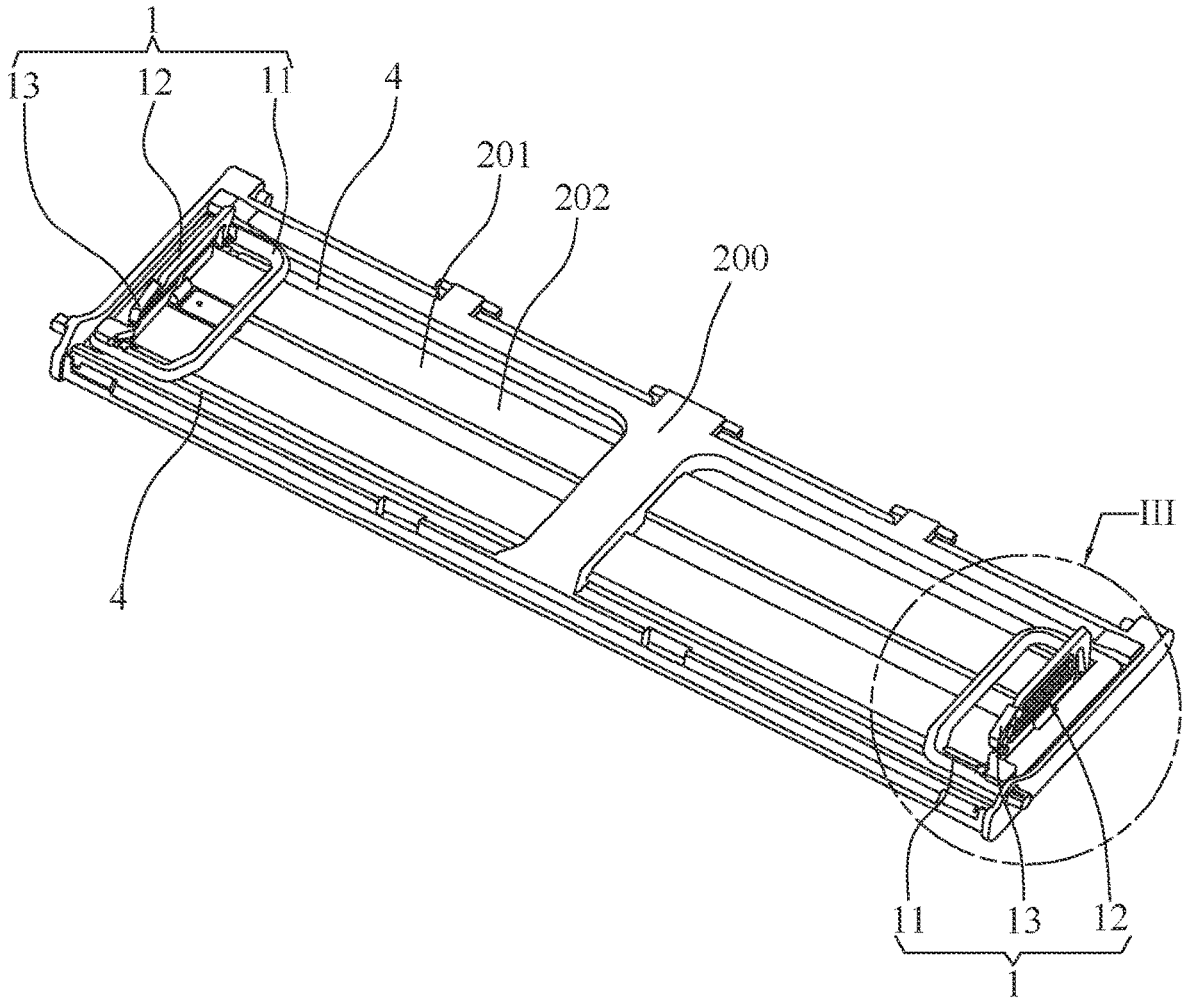
FIG. 2 is a perspective view showing an initial state of the foldable baffle structure being mounted to the tray of the scanner in accordance with the present invention.
Figure 3:
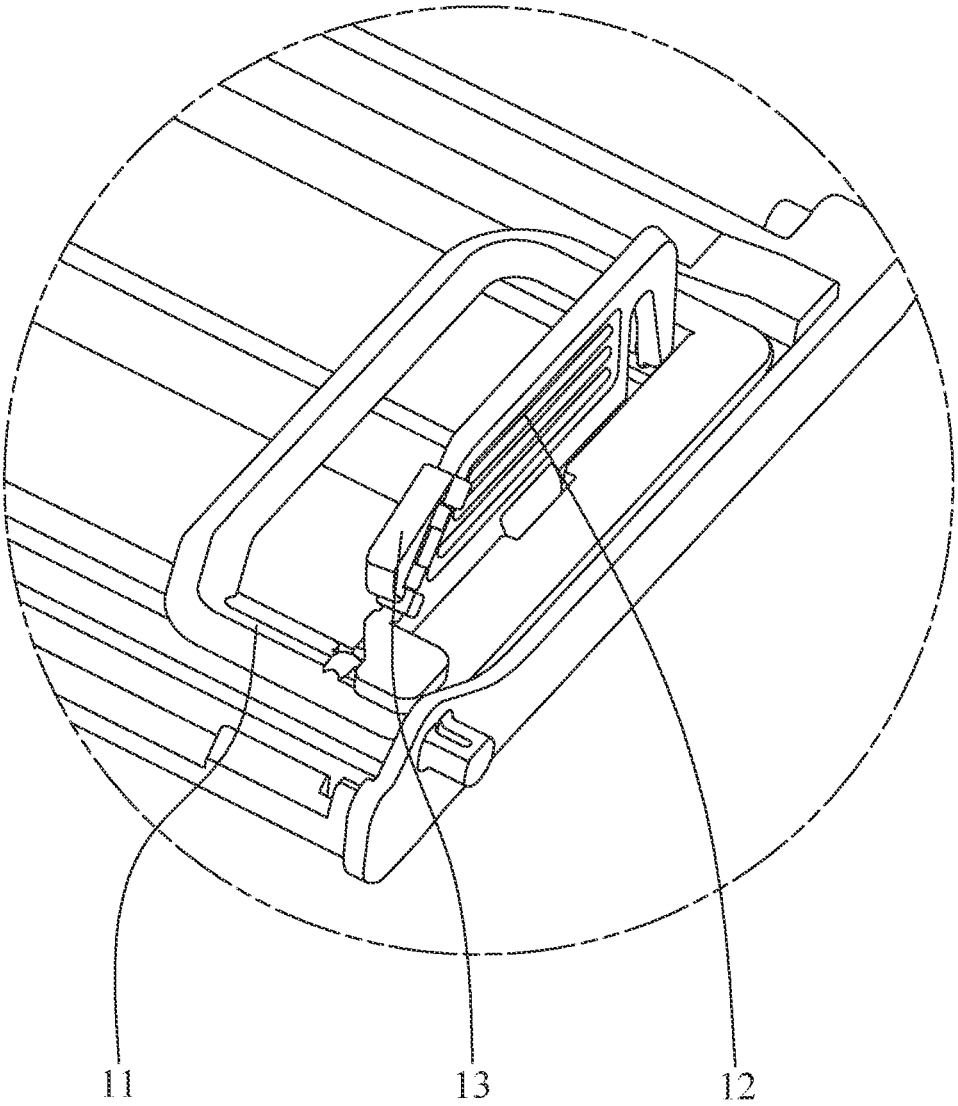
FIG. 3 is an enlarged view of an encircled portion III of the scanner of FIG. 2.

With reference to FIG. 1 to FIG. 3, a foldable baffle structure 100 in accordance with a preferred embodiment of the present invention is shown. The foldable baffle structure 100 is mounted to a tray 200 of a scanner 300 or a printer. The foldable baffle structure 100 includes a limiting component 1 mounted to the tray 200. Preferably, the foldable baffle structure 100 includes two limiting components 1.

With reference to FIG. 1 to FIG. 12, the limiting component 1 includes a sliding element 11 mounted to the tray 200, a stopping element 12, an elastic element 3, a guiding element 13. A middle of the sliding element 11 of the limiting component 1 has an accommodating space 111 penetrating through a top surface and a bottom surface of the sliding element 11. Two inner surfaces of two end walls of the accommodating space 111 of the limiting component 1 are recessed oppositely to form two opposite pivoting slots 112. The accommodating space 111 of the limiting component 1 has an extension portion 113 arranged between and connected between two inner portions of two opposite side walls of the accommodating space 111 of the limiting component 1. One side of an upper portion of the extension portion 113 of the limiting component 1 protrudes upward and then extends towards one end wall of the accommodating space 111 to form a first pivoting block 114. The extension portion 113 of the limiting component 1 has a through-hole 115 located below the first pivoting block 114.

The stopping element 12 is pivotally mounted in the accommodating space 111 of the sliding element 11 of the limiting component 1. Two opposite end surfaces of the stopping element 12 protrude oppositely to form two second pivoting blocks 121. The two second pivoting blocks 121 are disposed corresponding to the two pivoting slots 112, respectively. A middle of a bottom of the stopping element 12 is recessed inward to form a receiving groove 122. A middle of a top wall of the receiving groove 122 is further recessed inward to form a limiting groove 1221.

The elastic element 3 is mounted around a free end of the first pivoting block 114 of the sliding element 11 of the limiting component 1. The first pivoting block 114 and the elastic element 3 of the limiting component 1 is received in the receiving groove 122 of the stopping element 12 of the limiting component 1. One end of the elastic element 3 passes through the through-hole 115 of the sliding element 11 and abuts against a bottom of the extension portion 113 of the sliding element 11, and the other end of the elastic element 3 is inserted into the limiting groove 1221 of the stopping element 12. A middle of one end surface of the stopping element 12 of the limiting component 1 protrudes outward to form a pivoting portion 124. The pivoting portion 124 of the limiting component 1 has a pivoting opening 125 slantwise extending from up to down and penetrating through two opposite end surfaces of the pivoting portion 124 of the limiting component 1.

The guiding element 13 is mounted around an outside of the pivoting portion 124. The guiding element 13 is pivotally mounted to one end surface of the stopping element 12. Two ends of the guiding element 13 slantwise protrude forward and sideward to form two bumps 131 towards the pivoting portion 124. Two facing inner end surfaces of the two bumps 131 of the guiding element 13 define two fixing holes 132 penetrating through two outer end surfaces of the two bumps 131. The guiding element 13 of the limiting component 1 is mounted to the pivoting portion 124 of the limiting component 1, and the two fixing holes 132 of the limiting component 1 are corresponding to two opposite ends of the pivoting opening 125 of the pivoting portion 124 of the limiting component 1.

When the foldable baffle structure 100 is in an initial state, the elastic element 3 props up the stopping element 12 outwardly, and the stopping element 12 abuts against the top surface of the sliding element 11, so that the stopping element 12 is pivoted to the sliding element 11 to maintain an upwardly upright state, the guiding element 13 is pivoted to the stopping element 12 to maintain an angle between the guiding element 13 and the stopping element 12. When the tray 200 and the stopping element 12 enter a folded state and an accommodated state, the tray 200 covers an outer shell 301 of the scanner 300 or the printer, the stopping element 12 and the guiding element 13 of the limiting component 1 move towards an upper surface of a blocking wall 302 of the outer shell 301 of the scanner 300 or the printer, and the stopping element 12 and the guiding element 13 of the limiting component 1 are pushed inward by the upper surface of the blocking wall 302 of the scanner 300 or the printer. When the foldable baffle structure 100 is in the folded state, the stopping element 12 is pivoted to the sliding element 11 to be received in the accommodating space 111, the guiding element 13 is pivoted to the stopping element 12 to be maintained in a same plane with the stopping element 12.

Figure 4:
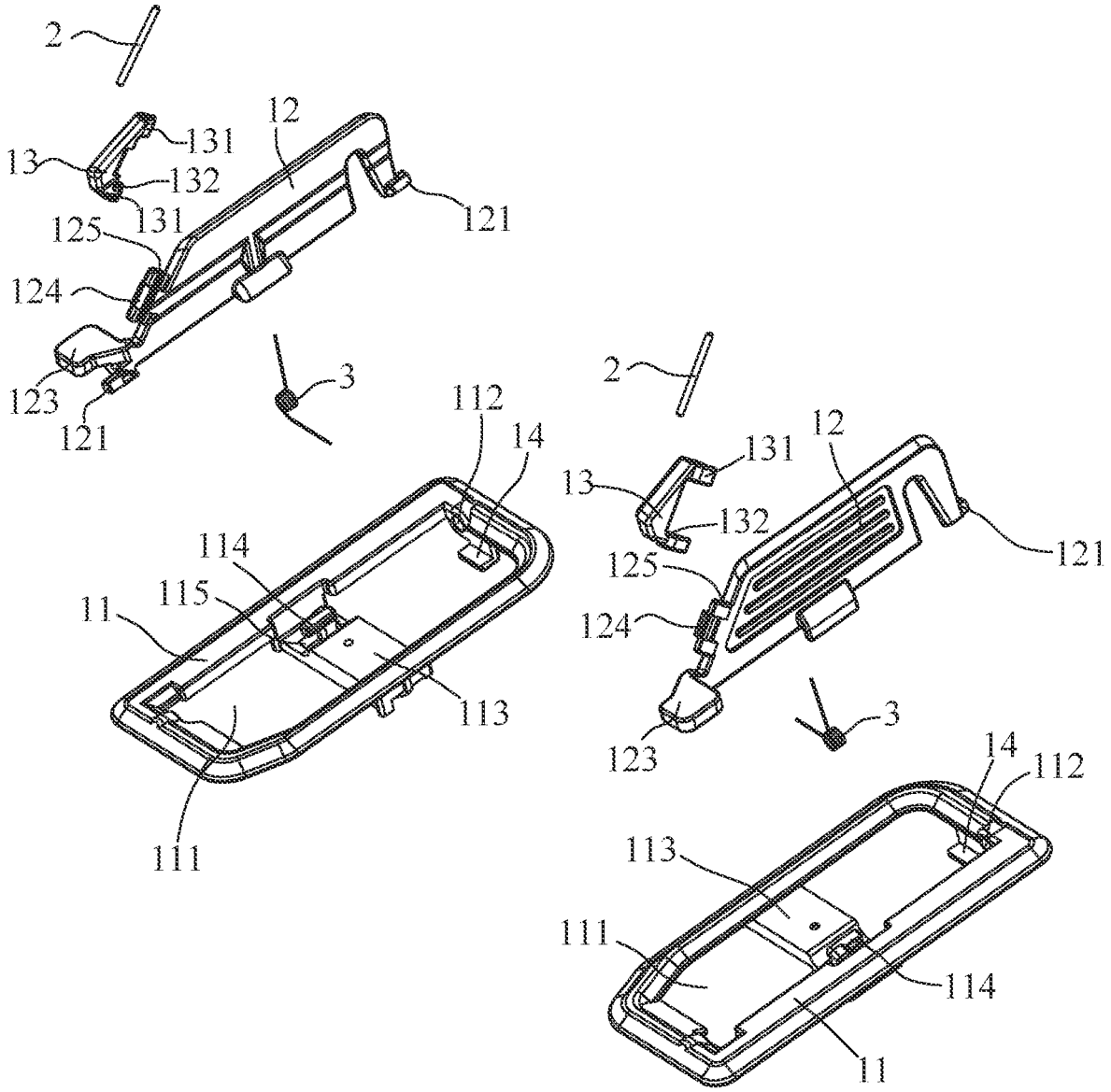
FIG. 4 is an exploded perspective view of the foldable baffle structure in accordance with the present invention.
Figure 5:
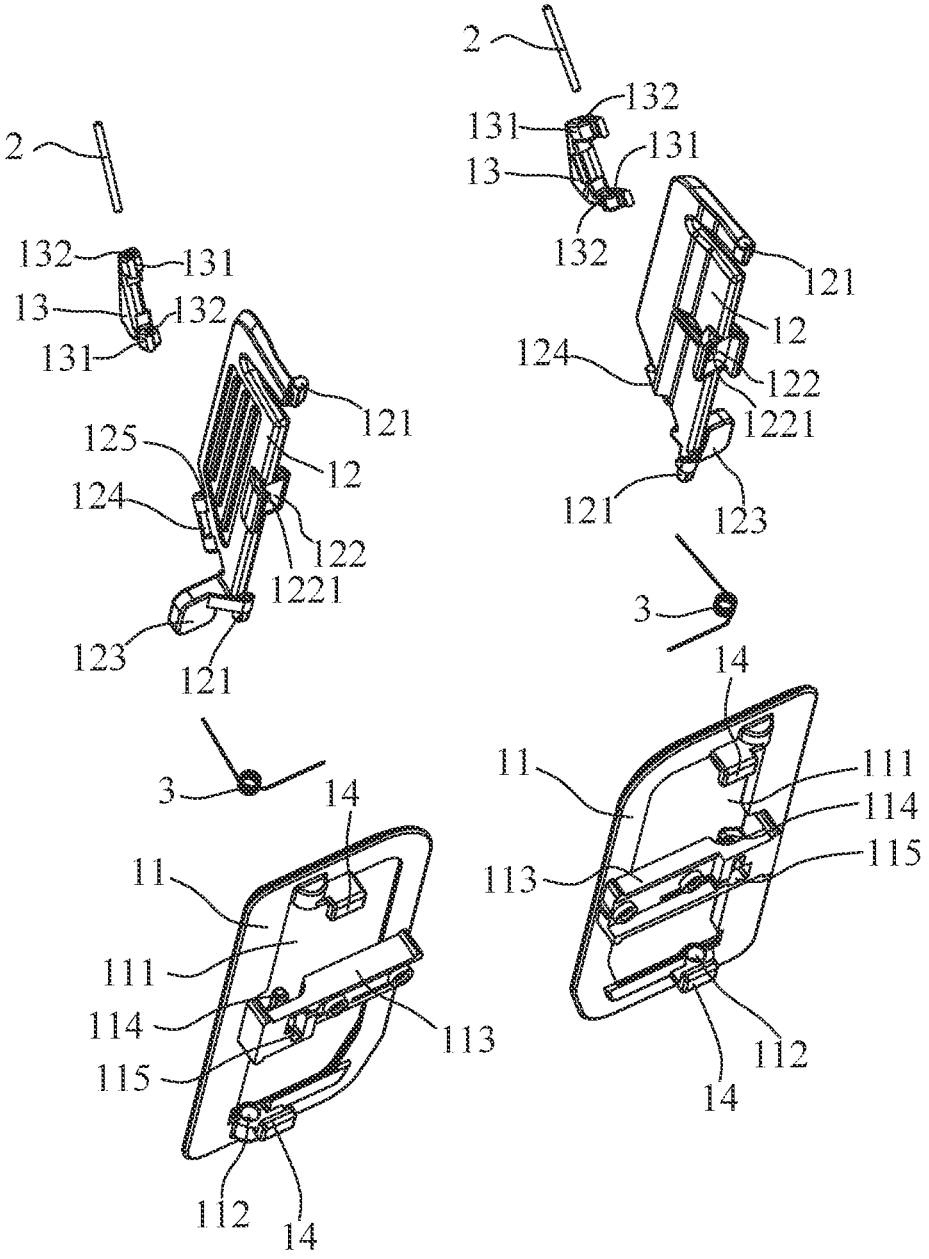
FIG. 5 is another exploded perspective view of the foldable baffle structure in accordance with the present invention.

Preferably, with reference to FIG. 4 and FIG. 5, the two limiting components 1 are mounted to the tray 200. The two limiting components 1 are corresponding to each other and are parallel to each other. Each limiting component 1 includes the sliding element 11, the stopping element 12 and the guiding element 13. Middles of the two sliding elements 11 of the two limiting components 1 have two accommodating spaces 111 penetrating through the top surfaces and the bottom surfaces of the two sliding elements 11. The two inner surfaces of the two end walls of the accommodating space 111 of each limiting component 1 are recessed oppositely to form the two opposite pivoting slots 112. The accommodating space 111 of each limiting component 1 has the extension portion 113 arranged between and connected between the two inner portions of the two opposite side walls of the accommodating space 111 of each limiting component 1. The one side of the upper portion of the extension portion 113 of each limiting component 1 protrudes upward and then extends towards the one end wall of the accommodating space 111 to form the first pivoting block 114. The extension portion 113 of each limiting component 1 has the through-hole 115 located below the first pivoting block 114.

The two stopping elements 12 of the two limiting components 1 are mounted in the two accommodating spaces 111 of the two limiting components 1. The two opposite end surfaces of the stopping element 12 protrude oppositely to form two second pivoting blocks 121. The two second pivoting blocks 121 are disposed corresponding to the two pivoting slots 112, respectively. The middle of the bottom of the stopping element 12 is recessed inward to form the receiving groove 122. The middle of the top wall of the receiving groove 122 is further recessed inward to form the limiting groove 1221. A junction between one side and one end of the stopping element 12 extends sideward and outward to form an abutting portion 123. The middle of the one end surface of the stopping element 12 of each limiting component 1 protrudes outward to form the pivoting portion 124. The pivoting portion 124 of each limiting component 1 is substantially perpendicular to the one end surface of the stopping element 12 of each limiting component 1. The pivoting portion 124 of each limiting component 1 has the pivoting opening 125 slantwise extending from up to down and penetrating through the two opposite end surfaces of the pivoting portion 124 of each limiting component 1.

The guiding element 13 of each limiting component 1 is mounted around the outside of the pivoting portion 124 of each limiting component 1. The guiding element 13 of each limiting component 1 is pivotally mounted to the one end surface of the stopping element 12 of each limiting component 1. The two ends of the guiding element 13 of each limiting component 1 slantwise protrude forward and sideward to form the two bumps 131 towards the pivoting portion 124. The two facing inner end surfaces of the two bumps 131 of the guiding element 13 of each limiting component 1 define the two fixing holes 132 penetrating through the two outer end surfaces of the two bumps 131. The guiding element 13 of each limiting component 1 is mounted to the pivoting portion 124 of one stopping element 12, and the two fixing holes 132 of each limiting component 1 are corresponding to the two opposite ends of the pivoting opening 125 of the pivoting portion 124 of the one stopping element 12.

Figure 6:
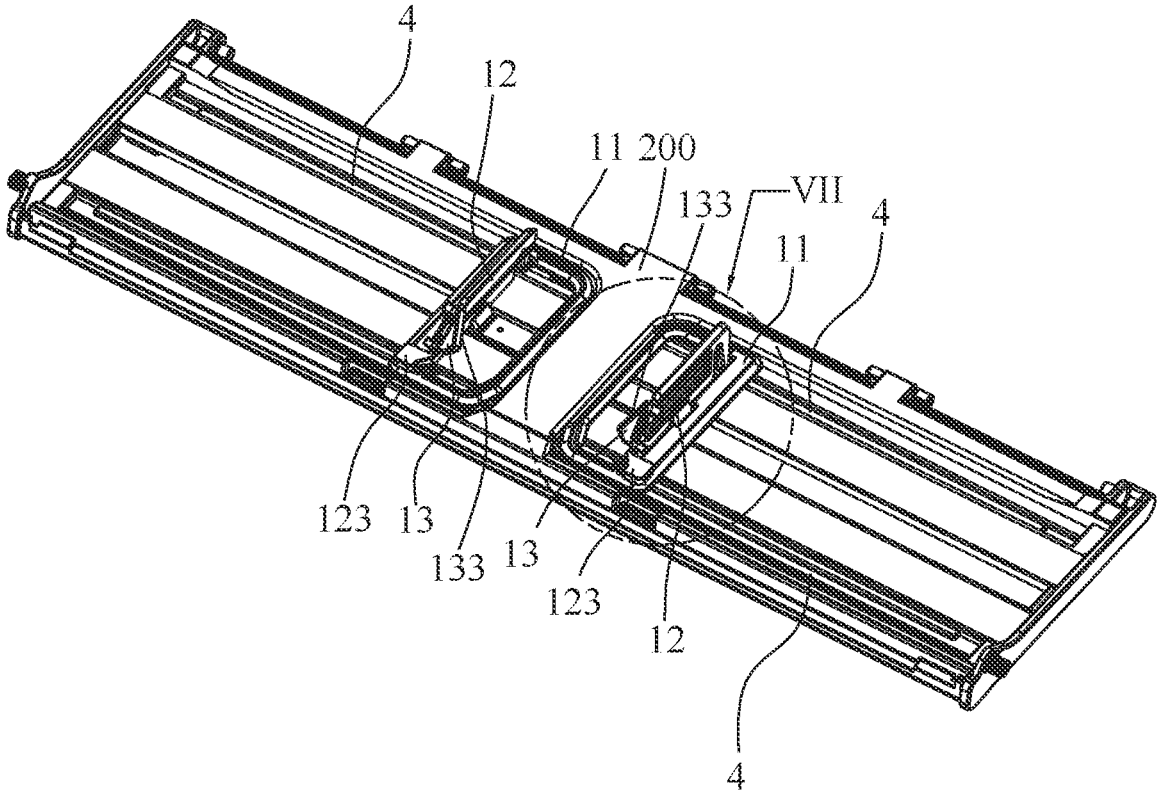
FIG. 6 is a perspective view showing a guiding state of a guiding element of the foldable baffle structure mounted to the tray of the scanner in accordance with the present invention.
Figure 7:
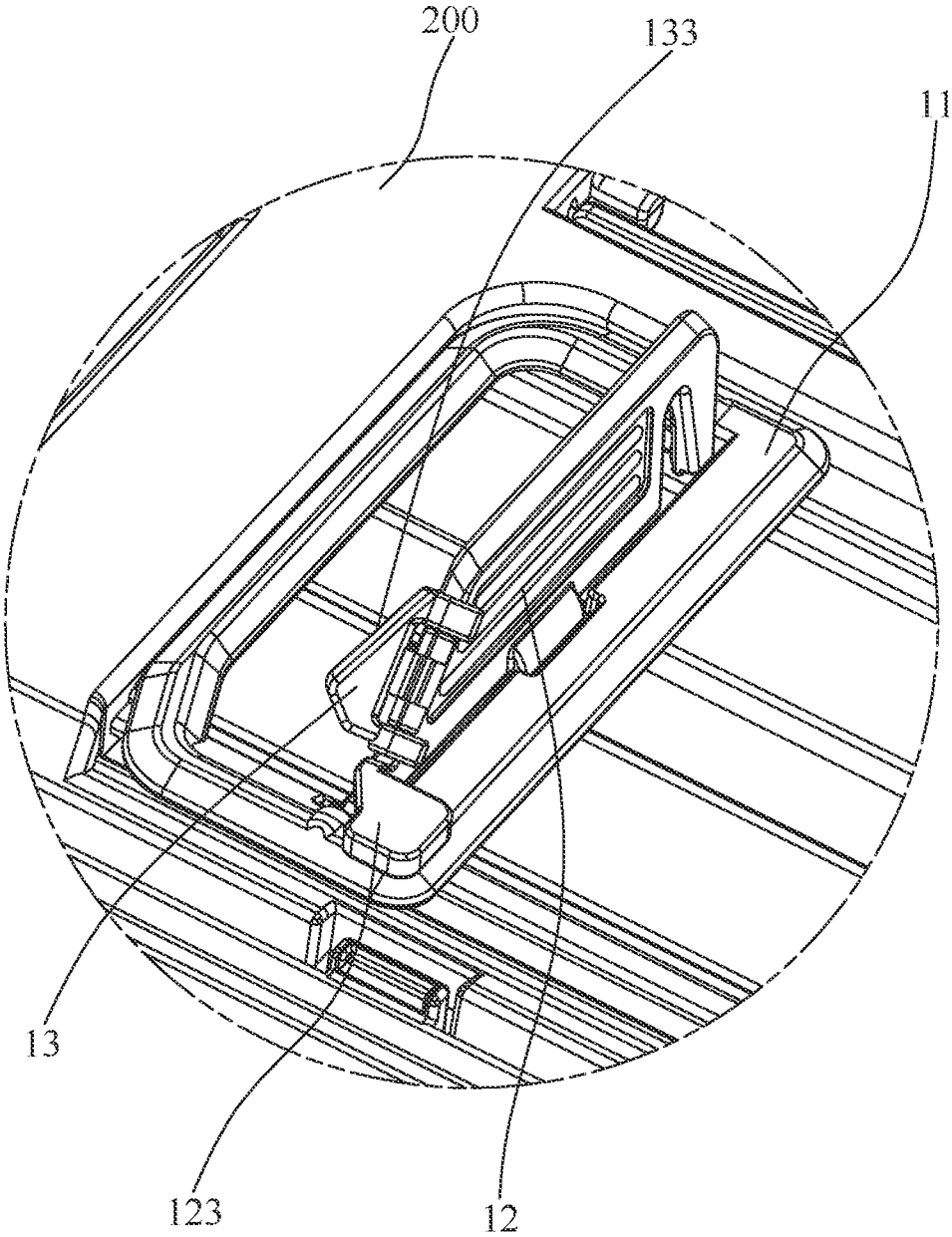
FIG. 7 is an enlarged view of an encircled portion VII of the scanner of FIG. 6.
Figure 8:
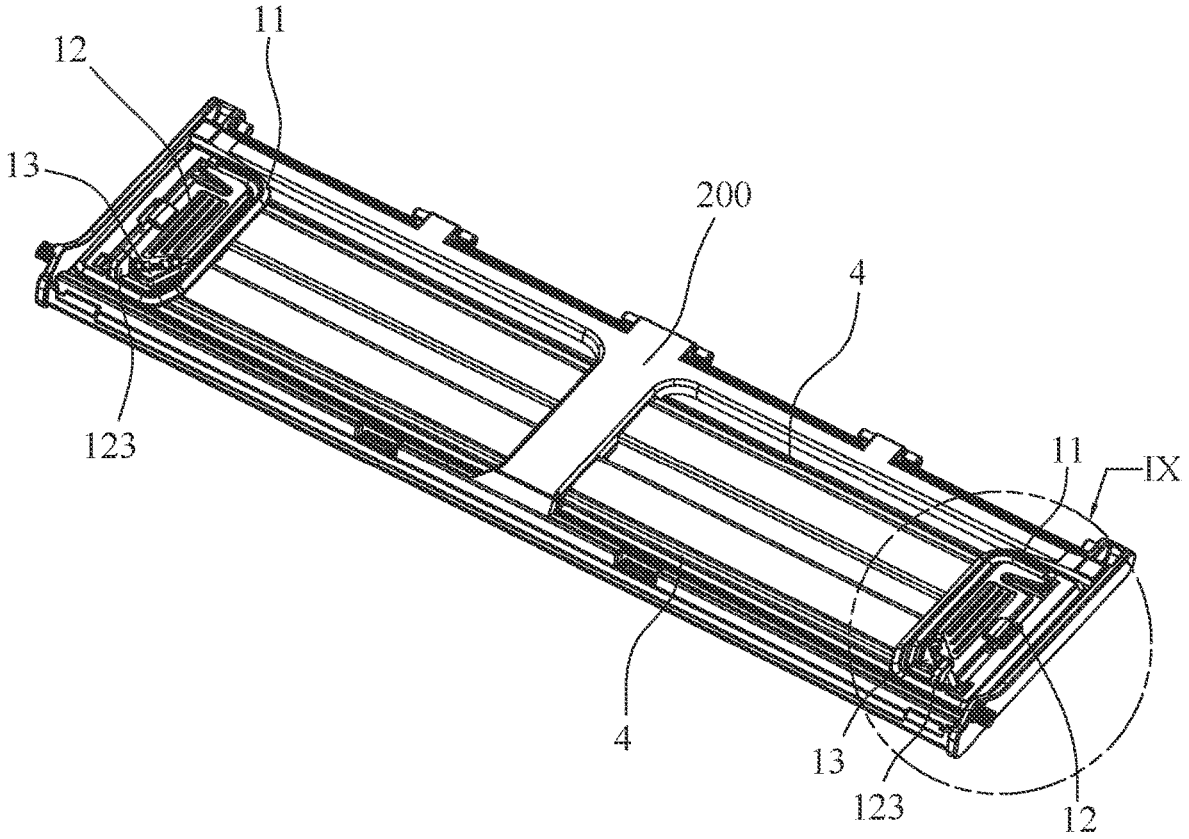
FIG. 8 is a perspective view showing a folded state of the foldable baffle structure being mounted to the tray of the scanner in accordance with the present invention.
Figure 9:
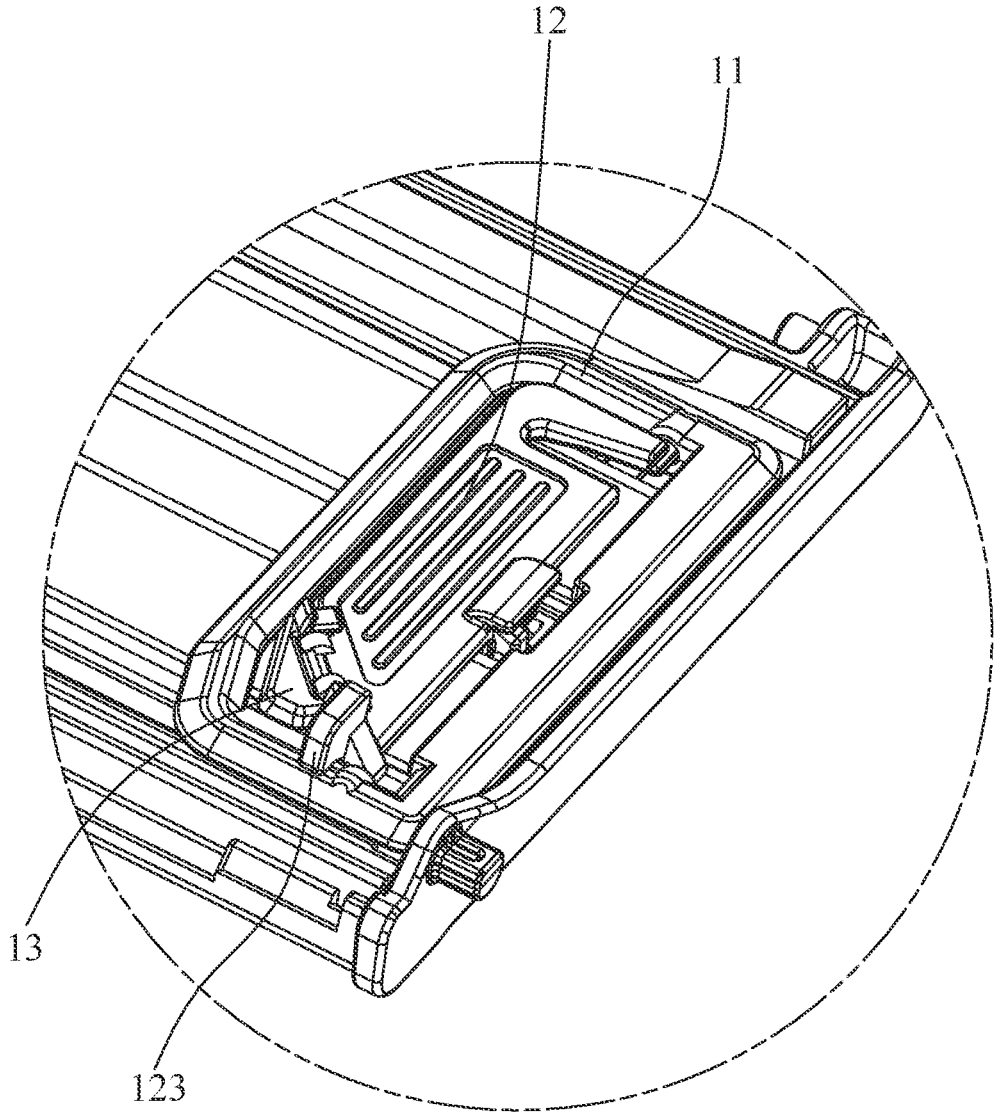
FIG. 9 is an enlarged view of an encircled portion IX of the scanner of FIG. 8.

With reference to FIG. 4, FIG. 6 and FIG. 7, each limiting component 1 of the foldable baffle structure 100 further includes a pivoting element 2. The pivoting element 2 is pivotally disposed in the pivoting opening 125 of the stopping element 12. Two ends of the pivoting element 2 are pivotally mounted in the two fixing holes 132 of the guiding element 13, respectively. The two guiding elements 13 are able to rotate inward to an angle by pivoting the two pivoting elements 2 to enter a guiding state, so that the two guiding elements 13 have two inclined surfaces 133 slantwise inclined towards the tray 200 from top to bottom and located between the two guiding elements 13 and the tray 200. When a user scans paper or a card, the paper or the card passes through the two guiding elements 13 and moves downward and downstream to be attached on the tray 200 along the two inclined surfaces 133, so that the paper or the card will be kept flat, and the paper or the card enters the scanner 300 or the printer to be scanned or be printed under a flatness state of the paper or the card. In that case, the paper or the card is transmitted into the scanner 300 or the printer smoothly.

With reference to FIG. 1 to FIG. 9, each limiting component 1 of the foldable baffle structure 100 includes the elastic element 3. The two first pivoting blocks 114 of the two sliding elements 11 of the two limiting components 1 are equipped with the two elastic elements 3 of the two sliding elements 11 of the two limiting components 1. The two elastic elements 3 are mounted around the free ends of the two first pivoting blocks 114 of the two sliding elements 11 of the two limiting components 1. The two first pivoting blocks 114 and the two elastic elements 3 of the two limiting components 1 are received in the two receiving grooves 122 of the two stopping elements 12 of the two limiting components 1. Side walls of the two receiving grooves 122 of the two stopping elements 12 cover the two first pivoting blocks 114 and the two elastic elements 3. Each elastic element 3 is a torsion spring. One end of each elastic element 3 passes through the through-hole 115 of one sliding element 11 and abuts against the bottom of the extension portion 113 of the one sliding element 11, and the other end of each elastic element 3 is inserted into the limiting groove 1221 of the one stopping element 12.

When the foldable baffle structure 100 is in the initial state, the two elastic elements 3 prop up the two stopping elements 12 outwardly, and the two abutting portions 123 of the two stopping elements 12 abut against the top surfaces of the two sliding elements 11, so that positions of the two stopping elements 12 are on the tray 200, and the two stopping elements 12 are pivoted to the two sliding elements 11 and maintain the upwardly upright states, the two guiding elements 13 are pivoted to the two stopping elements 12 to maintain the two angles between the two guiding elements 13 and the two stopping elements 12.

When the tray 200 and the two stopping elements 12 enter the folded state and the accommodated state, the tray 200 covers the outer shell 301 of the scanner 300 or the printer, the two stopping elements 12 and the two guiding elements 13 of the two limiting components 1 move towards the upper surface 303 of the blocking wall 302 of the outer shell 301 of the scanner 300 or the printer, and the two stopping elements 12 and the two guiding elements 13 of the two limiting components 1 are pushed inward by the upper surface 303 of the blocking wall 302 of the scanner 300 or the printer, so the two stopping elements 12 and the two guiding elements 13 of the two limiting components 1 are disposed horizontally. The two stopping elements 12 are pivoted to the two sliding elements 11 to be received in the two accommodating spaces 111 of the two limiting components 1. The two guiding elements 13 are pivoted to the two stopping elements 12 to be maintained in the same plane with the two stopping elements 12. The two second pivoting blocks 121 of the two stopping elements 12 of the two limiting components 1 will rotate by virtue of the two second pivoting blocks 121 of the two stopping elements 12 of the two limiting components 1 being pivoted in the two pivoting slots 112 along a longitudinal direction, so that the two stopping elements 12 of the two limiting components 1 face towards each other in a transverse direction, correspondingly the two stopping elements 12 of the two limiting components 1 are in a state of being disposed towards each other in the transverse direction, and the two guiding elements 13 of the two limiting components 1 will pivotally rotate back to the initial states of the two guiding elements 13. In this way, the two stopping elements 12 and the two guiding elements 13 of the two limiting components 1 are accommodated in the two accommodating spaces 111 of the two limiting components 1. At the moment, the two elastic elements 3 accumulate resilience forces.

When the user wants to use the scanner 300 or the printer, the user opens the tray 200 outward, at the moment, the two elastic elements 3 provide the resilience forces for the two stopping elements 12 of the two limiting components 1, and the two second pivoting blocks 121 of the two stopping elements 12 of the two limiting components 1 rotate and are pivoted in the two pivoting slots 112, so that the two stopping elements 12 of the two limiting components 1 will return back to initial states of the two stopping elements 12 automatically.

With reference to FIG. 1 to FIG. 7, an upper portion 202 of an appearance surface 201 of the tray 200 has two sliding grooves 4 recessed downward and extending along the transverse direction. The two sliding grooves 4 are spaced from each other. Two ends of a bottom of each sliding element 11 protrude downward and then are bent towards each other to form two sliding parts 14. The two sliding parts 14 of each sliding element 11 are slidably mounted in the two sliding grooves 4. The two sliding parts 14 are able to slide along the two sliding grooves 4. A distance between the two limiting components 1 are able to be adjusted by virtue of the sliding parts 14 of the two limiting components 1 sliding along the two sliding grooves 4 of the tray 200, and the two extension portions 113 of the two limiting components 1 slide along a middle position of the upper portion 202 of the appearance surface 201 of the tray 200 between the two sliding grooves 4, so that the tray 200 of the scanner 300 or the printer is able to be used in cooperation with the paper or the card in different sizes.

Figure 10:
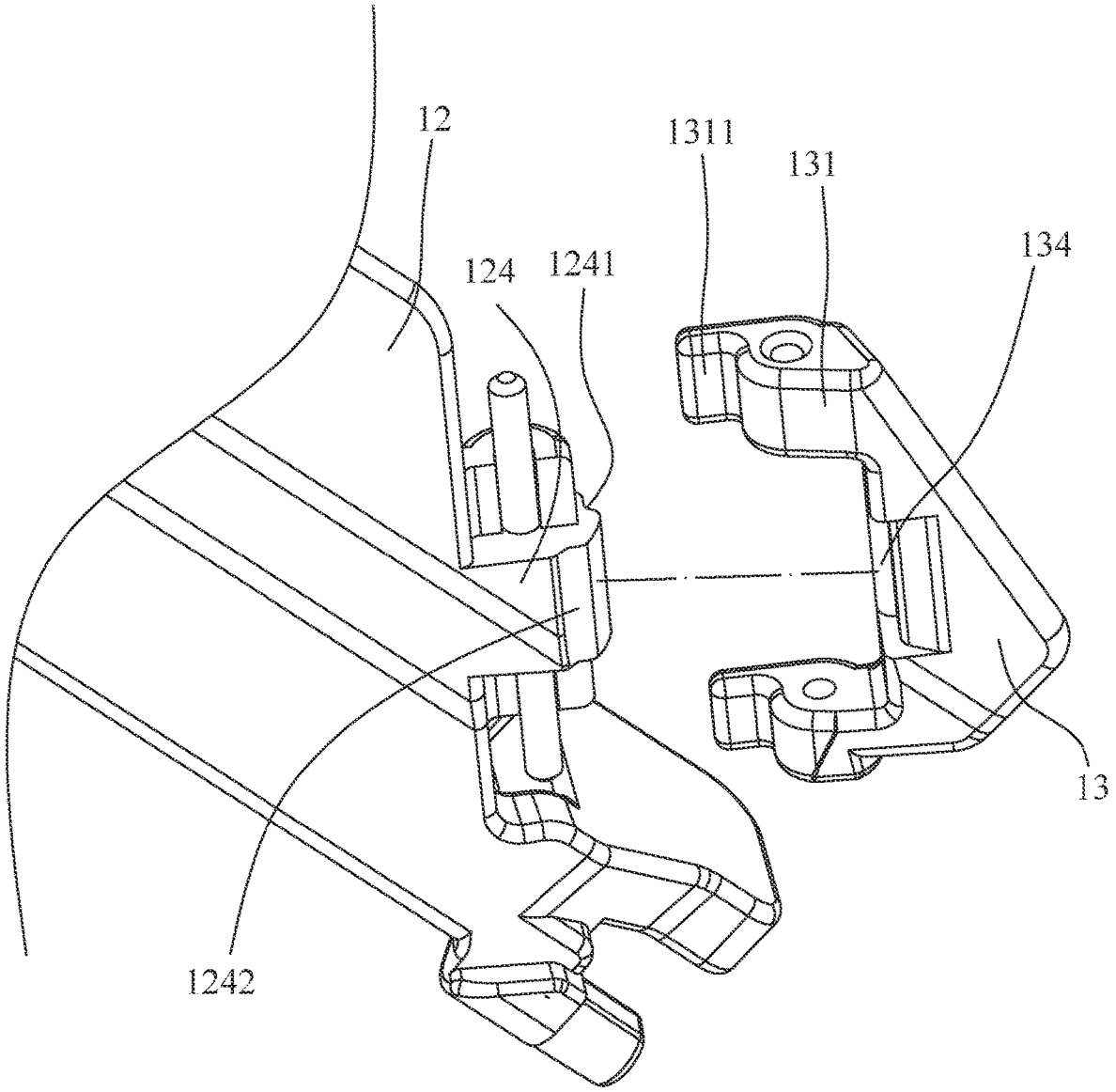
FIG. 10 is a partial exploded perspective view of the foldable baffle structure in accordance with the present invention, wherein a stopping element is separated from the guiding element.

With reference to FIG. 10, an outer portion and an inner portion of the pivoting portion 124 are recessed inward to form a first locating groove 1241 and a second locating groove 1242. A middle of an inner side of the guiding element 13 protrudes towards the pivoting portion 124 to form a locating portion 134 located between the two bumps 131 of the guiding element 13. The locating portion 134 is mounted in the first locating groove 1241 or the second locating groove 1242 by virtue of the guiding element 13 being pivoted to the stopping element 12. Free ends of the two bumps 131 of the guiding element 13 protrude outward to form two blocking portions 1311. The two blocking portions 1311 abut an outer side surface of the stopping element 12 to limit a position of the guiding element 13. The two blocking portions 1311 are located to and adjacent to two ends of the pivoting portion 124 of the stopping element 12.

Figure 11:
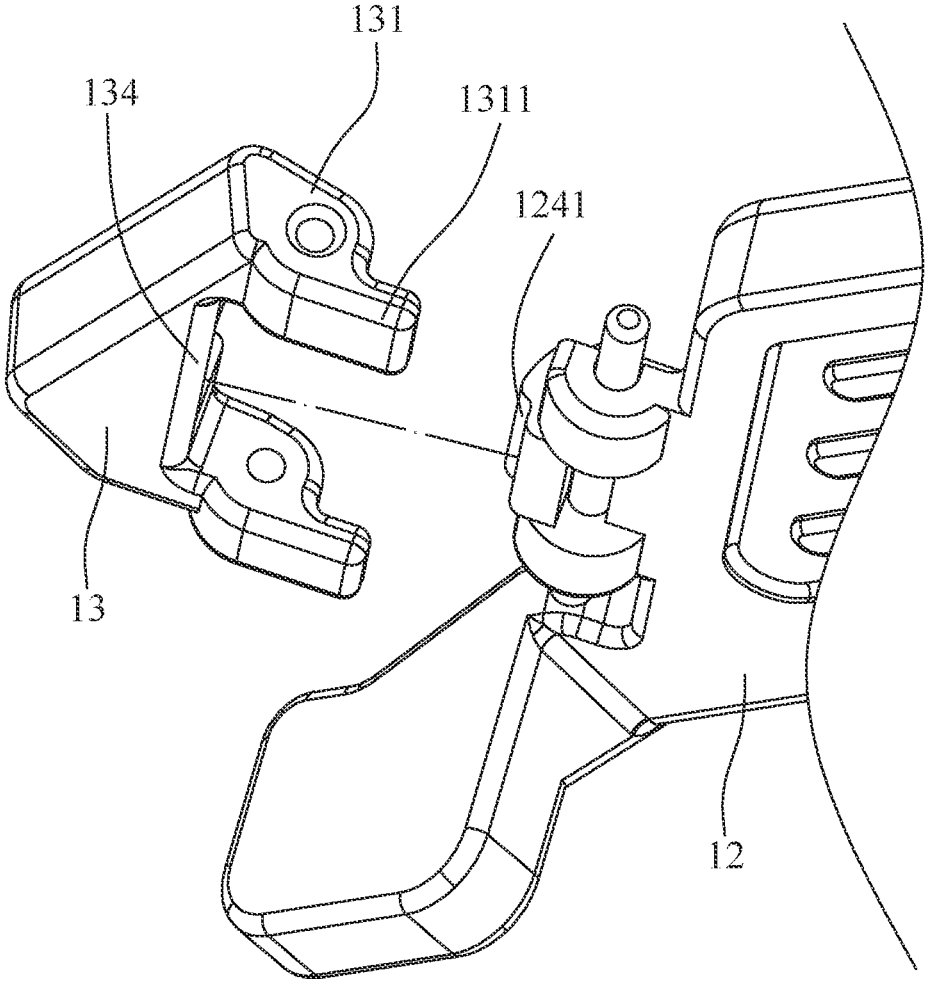
FIG. 11 is another partial exploded perspective view of the foldable baffle structure in accordance with the present invention, wherein the stopping element and the guiding element of the foldable baffle structure are separated from each other and are in the initial state.
Figure 12:
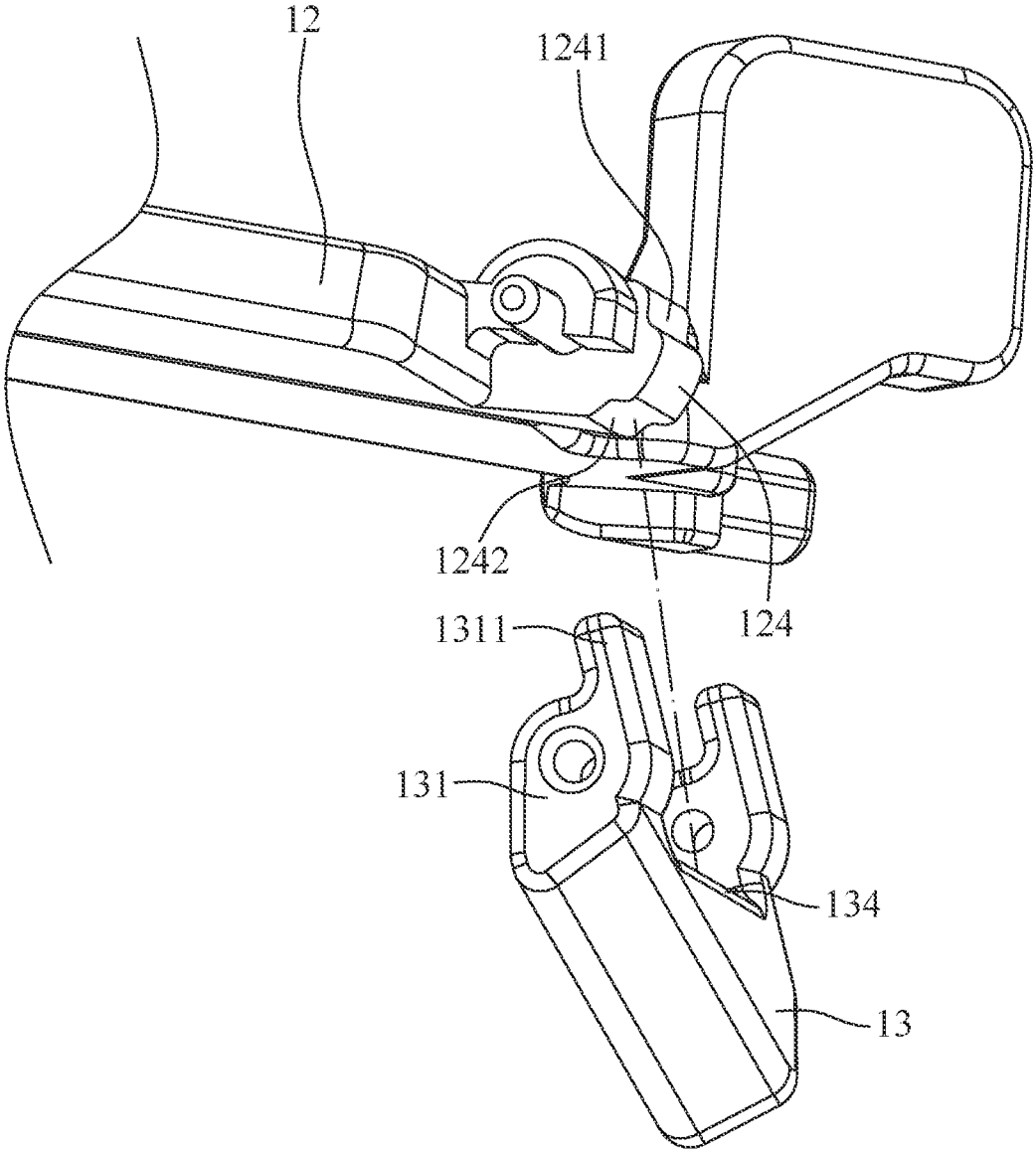
FIG. 12 is one more partial exploded perspective view of the foldable baffle structure in accordance with the present invention, wherein the stopping element is separated from the guiding element in the guiding state.

With reference to FIG. 11 and FIG. 12, the initial state of the guiding element 13 is shown in FIG. 11. When the guiding element 13 is in the initial state and is disposed horizontally, the locating portion 134 is mounted in the first locating groove 1241 to fix the position of the guiding element 13, and the two blocking portions 1311 abut the stopping element 12 to limit the position of the guiding element 13. The guiding state of the guiding element 13 is shown in FIG. 12. When the guiding element 13 is in the guiding state, the locating portion 134 is mounted in the second locating groove 1242 to fix the position of the guiding element 13, and the stopping element 12 is in the upwardly upright state.

As described above, the foldable baffle structure 100 has a folded performance and an accommodated characteristic, so that a required space of the tray 200 is saved, the two stopping elements 12 of the two limiting components 1 are able to return back to the initial states of the two stopping elements 12 automatically by virtue of resilience characteristics of the two elastic elements 3, and the two stopping elements 12 and the two guiding elements 13 of the two limiting components 1 are disposed horizontally, correspondingly, the foldable baffle structure 100 reduces an appearance size of a product which is the scanner 300 or the printer to decrease a space occupied by the scanner 300 or the printer and further reduces a material cost. As a result, it is convenient for the user to use the foldable baffle structure 100 applied in the scanner 300 or the printer.

What is claimed is:

1. A foldable baffle structure mounted to a tray of a scanner or a printer, comprising:

two limiting components mounted to the tray, the two limiting components being corresponding to each other and being parallel to each other, each limiting component including a sliding element, middles of the two sliding elements of the two limiting components having two accommodating spaces penetrating through top surfaces and bottom surfaces of the two sliding elements, two inner surfaces of two end walls of the accommodating space of each limiting component being recessed oppositely to form two opposite pivoting slots, the accommodating space of each limiting component having an extension portion arranged between and connected between two inner portions of two opposite side walls of the accommodating space of each limiting component, one side of an upper portion of the extension portion of each limiting component protruding upward and then extending towards one end wall of the accommodating space to form a first pivoting block, the extension portion of each limiting component having a through-hole located below the first pivoting block, a stopping element, the two stopping elements of the two limiting components being mounted in the accommodating spaces of the two limiting components, two opposite end surfaces of the stopping element protruding oppositely to form two second pivoting blocks, the two second pivoting blocks being disposed corresponding to the two pivoting slots, respectively, a middle of a bottom of the stopping element being recessed inward to form a receiving groove, a middle of a top wall of the receiving groove being further recessed inward to form a limiting groove, the two first pivoting blocks of the two sliding elements of the two limiting components being equipped with two elastic elements, side walls of the two receiving grooves of the two stopping elements covering the two first pivoting blocks and the two elastic elements, one end of each elastic element passing through the through-hole of one sliding element and abutting against a bottom of the extension portion of the one sliding element, and the other end of each elastic element being inserted into the limiting groove of one stopping element, a middle of one end surface of the stopping element protruding outward to form a pivoting portion, the pivoting portion having a pivoting opening slantwise extending from up to down and penetrating through two opposite end surfaces of the pivoting portion, a guiding element mounted around an outside of the pivoting portion, two ends of the guiding element slantwise protruding forward and sideward to form two bumps towards the pivoting portion, two facing inner end surfaces of the two bumps of the guiding element defining two fixing holes penetrating through two outer end surfaces of the two bumps, the guiding element being mounted to the pivoting portion, and the two fixing holes being corresponding to two opposite ends of the pivoting opening of the pivoting portion, and a pivoting element pivotally disposed in the pivoting opening of the stopping element, two ends of the pivoting element being pivotally mounted in the two fixing holes of the guiding element, respectively.

2. The foldable baffle structure as claimed in claim 1, wherein a junction between one side and one end of the stopping element extends sideward and outward to form an abutting portion, when the foldable baffle structure is in an initial state, the two elastic elements prop up the two stopping elements outwardly, and the two abutting portions of the two stopping elements abut against the top surfaces of the two sliding elements.

3. The foldable baffle structure as claimed in claim 1, wherein an upper portion of an appearance surface of the tray has two sliding grooves recessed downward and extending along a transverse direction, the two sliding grooves are spaced from each other, two ends of a bottom of each sliding element protrudes downward and then are bent towards each other to form two sliding parts, the two sliding parts of each sliding element are slidably mounted in the two sliding grooves, the two sliding parts are able to slide along the two sliding grooves.

4. The foldable baffle structure as claimed in claim 1, wherein each elastic element is a torsion spring.

5. The foldable baffle structure as claimed in claim 1, wherein an outer portion and an inner portion of the pivoting portion are recessed inward to form a first locating groove and a second locating groove, a middle of an inner side of the guiding element protrudes towards the pivoting portion to form a locating portion located between the two bumps of the guiding element, the locating portion is mounted in the first locating groove or the second locating groove by virtue of the guiding element being pivoted to the stopping element.

6. The foldable baffle structure as claimed in claim 1, wherein free ends of the two bumps of the guiding element protrude outward to form two blocking portions, the two blocking portions abut an outer side surface of the stopping element to limit a position of the guiding element.

7. A foldable baffle structure mounted to a tray of a scanner or a printer, comprising:

a limiting component mounted to the tray, the limiting component including a sliding element, a middle of the sliding element of the limiting component having an accommodating space penetrating through a top surface and a bottom surface of the sliding element, two inner surfaces of two end walls of the accommodating space of the limiting component being recessed oppositely to form two opposite pivoting slots, the accommodating space of the limiting component having an extension portion arranged between and connected between two inner portions of two opposite side walls of the accommodating space of the limiting component, one side of an upper portion of the extension portion of the limiting component protruding upward and then extending towards one end wall of the accommodating space to form a first pivoting block, the extension portion of the limiting component having a through-hole located below the first pivoting block, a stopping element mounted in the accommodating space of the limiting component, two opposite end surfaces of the stopping element protruding oppositely to form two second pivoting blocks, the two second pivoting blocks being disposed corresponding to the two pivoting slots, respectively, a middle of a bottom of the stopping element being recessed inward to form a receiving groove, a middle of a top wall of the receiving groove being further recessed inward to form a limiting groove, an elastic element mounted around a free end of the first pivoting block of the sliding element of the limiting component, the first pivoting block and the elastic element of the limiting component being received in the receiving groove of the stopping element of the limiting component, one end of the elastic element passing through the through-hole of the sliding element and abutting against a bottom of the extension portion of the sliding element, and the other end of the elastic element being inserted into the limiting groove of the stopping element, a middle of one end surface of the stopping element protruding outward to form a pivoting portion, the pivoting portion having a pivoting opening slantwise extending from up to down and penetrating through two opposite end surfaces of the pivoting portion, a guiding element mounted around an outside of the pivoting portion, two ends of the guiding element slantwise protruding forward and sideward to form two bumps towards the pivoting portion, two facing inner end surfaces of the two bumps of the guiding element defining two fixing holes penetrating through two outer end surfaces of the two bumps, the guiding element being mounted to the pivoting portion, and the two fixing holes being corresponding to two opposite ends of the pivoting opening of the pivoting portion, and a pivoting element, the pivoting element being pivotally disposed in the pivoting opening of the stopping element, two ends of the pivoting element being pivotally mounted in the two fixing holes of the guiding element, respectively, wherein when the foldable baffle structure is in an initial state, the elastic element props up the stopping element outwardly, and the stopping element abuts against the top surface of the sliding element, so that the stopping element maintains an upwardly upright state, and wherein when the tray and the stopping element enter a folded state and an accommodated state, the tray covers an outer shell of the scanner or the printer, the stopping element and the guiding element of the limiting component move towards an upper surface of a blocking wall of the outer shell of the scanner or the printer, and the stopping element and the guiding element of the limiting component are pushed inward by the upper surface of the blocking wall of the scanner or the printer.

8. The foldable baffle structure as claimed in claim 7, wherein an outer portion and an inner portion of the pivoting portion are recessed inward to form a first locating groove and a second locating groove, a middle of an inner side of the guiding element protrudes towards the pivoting portion to form a locating portion located between the two bumps of the guiding element, the locating portion is mounted in the first locating groove or the second locating groove by virtue of the guiding element being pivoted to the stopping element.

9. The foldable baffle structure as claimed in claim 7, wherein free ends of the two bumps of the guiding element protrude outward to form two blocking portions, the two blocking portions abut an outer side surface of the stopping element to limit a position of the guiding element.

10. A foldable baffle structure mounted to a tray of a scanner or a printer, comprising:

a sliding element mounted to the tray, a middle of the sliding element having an accommodating space penetrating through a top surface of the sliding element;

a stopping element pivotally mounted in the accommodating space of the sliding element; and a guiding element pivotally mounted to one end surface of the stopping element, wherein when the foldable baffle structure is in an initial state, the stopping element is pivoted to the sliding element to maintain in an upwardly upright state, the guiding element is pivoted to the stopping element to maintain an angle between the guiding element and the stopping element, and wherein when the foldable baffle structure is in a folded state, the stopping element is pivoted to the sliding element to be received in the accommodating space, the guiding element is pivoted to the stopping element to be maintained in a same plane with the stopping element.

11. The foldable baffle structure as claimed in claim 10, wherein a middle of the one end surface of the stopping element protrudes outward to form a pivoting portion, the pivoting portion has a pivoting opening slantwise extending from up to down and penetrating through two opposite end surfaces of the pivoting portion, two ends of the guiding element slantwise protrude forward and sideward to form two bumps towards the pivoting portion, two facing inner end surfaces of the two bumps of the guiding element define two fixing holes penetrating through two outer end surfaces of the two bumps, the guiding element is mounted to the pivoting portion, and the two fixing holes are corresponding to two opposite ends of the pivoting opening of the pivoting portion.

12. The foldable baffle structure as claimed in claim 11, wherein an outer portion and an inner portion of the pivoting portion are recessed inward to form a first locating groove and a second locating groove, a middle of an inner side of the guiding element protrudes towards the pivoting portion to form a locating portion located between the two bumps of the guiding element, the locating portion is mounted in the first locating groove or the second locating groove by virtue of the guiding element being pivoted to the stopping element.

13. The foldable baffle structure as claimed in claim 12, further comprising a pivoting element pivotally disposed in the pivoting opening of the stopping element, two ends of the pivoting element being pivotally mounted in the two fixing holes of the guiding element, respectively.

14. The foldable baffle structure as claimed in claim 11, wherein free ends of the two bumps of the guiding element protrude outward to form two blocking portions, the two blocking portions abut an outer side surface of the stopping element to limit a position of the guiding element.

* * * * *